United States Patent [19]

Nakanishi et al.

[11] Patent Number: 4,854,858

[45] Date of Patent: Aug. 8, 1989

[54] OIL RESERVOIR FOR OIL BURNER

[75] Inventors: Yutaka Nakanishi; Toshihiko Yamada, both of Aichi, Japan

[73] Assignee: Toyotomi Kogyo Co., Ltd., Japan

[21] Appl. No.: 226,118

[22] Filed: Jul. 29, 1988

[30] Foreign Application Priority Data

Jan. 31, 1987 [JP] Japan ..... 62-013638

[51] Int. Cl.[4] ..... F23D 3/24

[52] U.S. Cl. ..... 431/320; 126/96; 431/298

[58] Field of Search ..... 126/96, 97; 431/320, 431/321, 298, 201

[56] References Cited

U.S. PATENT DOCUMENTS 4,498,862 2/1985 Nakamura et al. ..... 126/96 X 4,569,652 2/1986 Nakamura et al. ..... 126/97 X

FOREIGN PATENT DOCUMENTS 029568 7/1976 Japan .

188504 12/1983 Japan .

*Primary Examiner*—Randall L. Green

*Attorney, Agent, or Firm*—Pollock, Vande Sande & Priddy

[57] ABSTRACT

An oil reservoir for an oil burner capable of ensuring oil-tightness between the oil reservoir and a partition with simple operation and structure and reducing a manufacturing cost. In the oil reservoir, a partition plate and a cover plate are provided with a plurality of spot welding portions and opposite to each other through an annular overlap formed therebetween. One of the partition plate and cover plate is formed at the overlap with an annular projection which is arranged in a manner to project toward the other to forcedly press the partition plate and cover plate against each other and the overlap is arranged at or near the spot welding portions, whereby the partition plate and cover plate are oil-tightly connected together.

8 Claims, 3 Drawing Sheets

OIL RESERVOIR FOR OIL BURNER

BACKGROUND OF THE INVENTION

1. Field of the Invention

This invention relates to an oil reservoir for an oil burner, and more particularly to an improvement in an oil reservoir of the double structure type for an oil burner.

2. Description of the Prior Art

Conventionally, an oil reservoir for an oil burner is generally constructed into a double structure so that leakage of fuel oil from the reservoir may be effectively prevented when the oil burner falls down sideways, as disclosed in Japanese Utility Model Publication No. 29568/1976. More particularly, the conventional oil reservoir is divided into an oil storing chamber and a wick receiving chamber by means of a partition. The partition airtightly isolates the oil storing chamber and the wick receiving chamber from each other. Fuel oil stored in the oil storing chamber is supplied little by little through a communication hole of the partition to the wick receiving chamber.

In the conventional oil reservoir constructed as described above, a failure in airtight connection between the partition and the oil reservoir causes air to pass through a connection therebetween, resulting in failing to prevent the above-described leakage of fuel oil from the oil reservoir. In order to avoid such a problem, the partition and oil reservoir are connected by seam welding for ensuring airtight connection therebetween.

However, seam welding requires large-scaled facilities and is highly troublesome in operation. Also, it causes workability to be deteriorated. Thus, it tends to produce many deficiencies in the oil reservoir.

In view of the foregoing, the assignee proposed to accomplish airtightness between the partition and the oil reservoir using a rubber packing as disclosed in Japanese Utility Model application No. 86463/1982 (Japanese Utility Model application Laying-Open Publication No. 188504/1983). Unfortunately, the approach incurs an increase in the number of parts used, resulting in failing a decrease in manufacturing cost.

Accordingly, it would be highly desirable to develop an oil reservoir for an oil burner which is capable of ensuring oil-tightness between the oil reservoir and a partition with simple operation and structure and reducing a manufacturing cost.

SUMMARY OF THE INVENTION

Generally speaking, an oil reservoir for an oil burner is provided. The oil reservoir includes a cover plate having a round outer end and a bottom plate having a round outer end and sealedly connected to a bottom of the cover plate to form a housing in which a closed space is defined. In a preferred embodiment, the cover plate and bottom plate each are formed into an annular shape. The oil reservoir also includes an annular partition plate arranged in the housing and connected at an upper end thereof to the cover plate and at a lower end thereof to the bottom plate to divide the closed space into an oil storing chamber and a wick receiving chamber. The partition plate is formed with at least one communication hole for ensuring fluid-communication between the oil storing chamber and the wick receiving chamber. In a preferred embodiment, two such communication holes are provided in a manner to be vertically spaced from each other. The partition plate and cover plate are provided with a plurality of spot welding portions at which spot welding is carried out to fix the partition plate and cover plate together to ensure oil-tightness between both. In the spot welding portions may be arranged in a circumferential direction of the oil reservoir. The partition plate and cover plate are opposite to each other through an annular overlap formed therebetween and one of the partition plate and cover plate is formed with an annular projection at the overlap. The projection is arranged in a manner to project toward the other of the partition plate and cover plate to forcedly press the partition plate and cover plate against each other. The overlap being arranged at or near he spot welding portions.

Accordingly, it is an object of the present invention to provide an oil reservoir for an oil burner which is capable of effectively preventing leakage of fuel oil therefrom.

It is another object of the present invention to provide an oil reservoir for an oil burner which is capable of accomplishing oil-tightness between a cover plate and a partition plate with a simple structure.

It is another object of the present invention to provide an oil reservoir for an oil burner which is capable of decreasing the number of parts.

It is a further object of the present invention to provide an oil reservoir for an oil burner which is capable of decreasing its manufacturing cost.

It is still another object of the present invention to provide an oil reservoir for an oil burner which is capable of significantly improving workability.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which like reference numerals designates like parts throughout; wherein.

DETAILED DESCRIPTION OF THE PREFERRED EMBODIMENT

Now, an oil reservoir for an oil burner according to the present invention will be described hereinafter with reference to the accompanying drawings.

Figure 1:
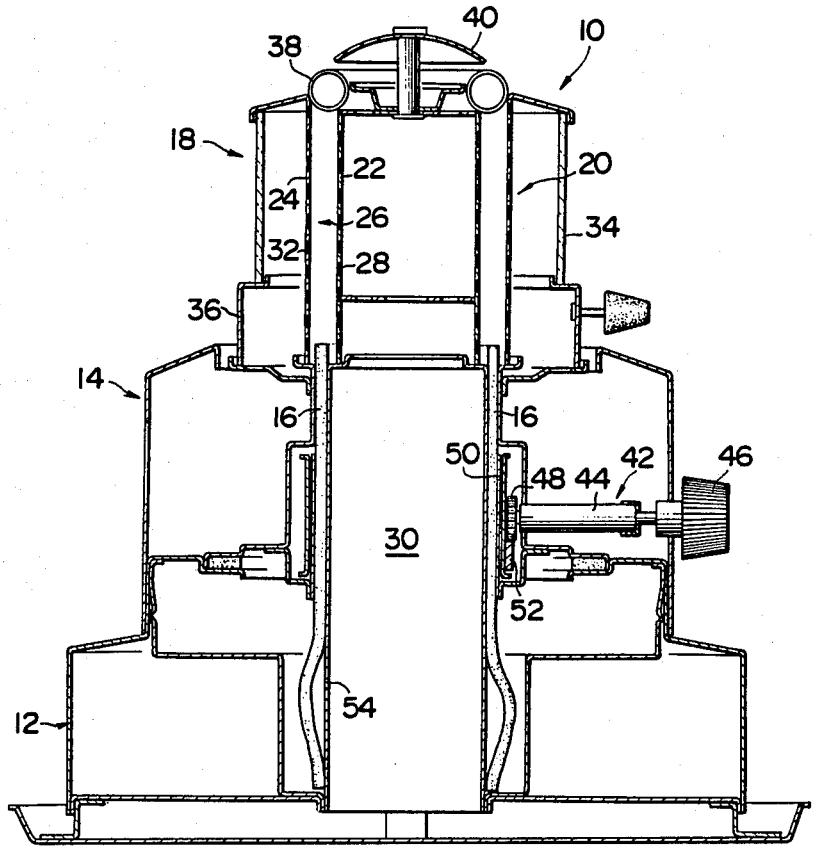
FIG. 1 is a vertical sectional view showing an example of an oil burner in which an oil reservoir according to the present invention is adapted to be incorporated.

FIG. 1 shows an example of an oil burner which is adapted to incorporate an oil reservoir according to the present invention therein, wherein an oil burner and an oil reservoir are generally designated by reference numerals 10 and 12, respectively. The oil burner 10 takes the form of a space heater, however, it should be noted that an oil burner to which an oil reservoir of the present invention is applied is not limited to a space heater.

The oil burner 10 illustrated in FIG. 1 is constructed in such a manner as widely known in the art, except the oil reservoir 12 of the present invention. The oil burner 10 includes a wick receiving cylinder construction 14 arranged on the oil reservoir 12. The wick receiving cylinder construction 14 is adapted to receive a wick 16 therein and communicated with the oil reservoir 12. The oil burner 10 also includes a combustion cylinder construction 18 arranged on the wick receiving cylinder 14.

The combustion cylinder construction 18 includes a double combustion cylinder 20 consisting of an inner cylindrical member 22 and an outer cylindrical member 24 which are arranged in a manner to be substantially concentric with each other through a space 26 of a suitable interval defined therebetween. The inner cylindrical member 22 is formed with a plurality of through-holes 28 which serve to introduce combustion air therethrough to the space 26 from an internal cylindrical space 30 formed in the oil burner 10 and communicated through a bottom of the burner with an ambient atmosphere. Likewise, the outer cylindrical member 24 is formed with a plurality of through-holes 32. The combustion cylinder construction 18 further includes a heat-permeable cylinder 34 supported through a support cylinder 36 on the wick receiving cylinder construction 14. On the combustion cylinder construction 18 are arranged a coil 38 formed of metal and a top plate 40.

The oil burner 10 further includes a wick actuating mechanism arranged at the wick receiving cylinder construction 14 and generally indicated at reference numeral 42, which is also constructed in a manner widely known in the art. The mechanism 42 includes a wick drive shaft 44 having a knob 46 and a pinion 48 respectively mounted at outer and inner ends thereof and a wick moving plate 50 having a rack 52 mounted on an outer surface side thereof. The wick 16 is held on an inner surface of the wick moving plate 50. The rack 52 is engaged with the pinion 48, so that the plate 50 may be vertically moved while being rotated through engagement between the pinion 48 and rack 52 when the drive shaft 44 is rotated, resulting in the wick 16 being vertically moved along a central base cylinder 54 of the oil burner 10 in which the space 30 is defined.

Figure 2:
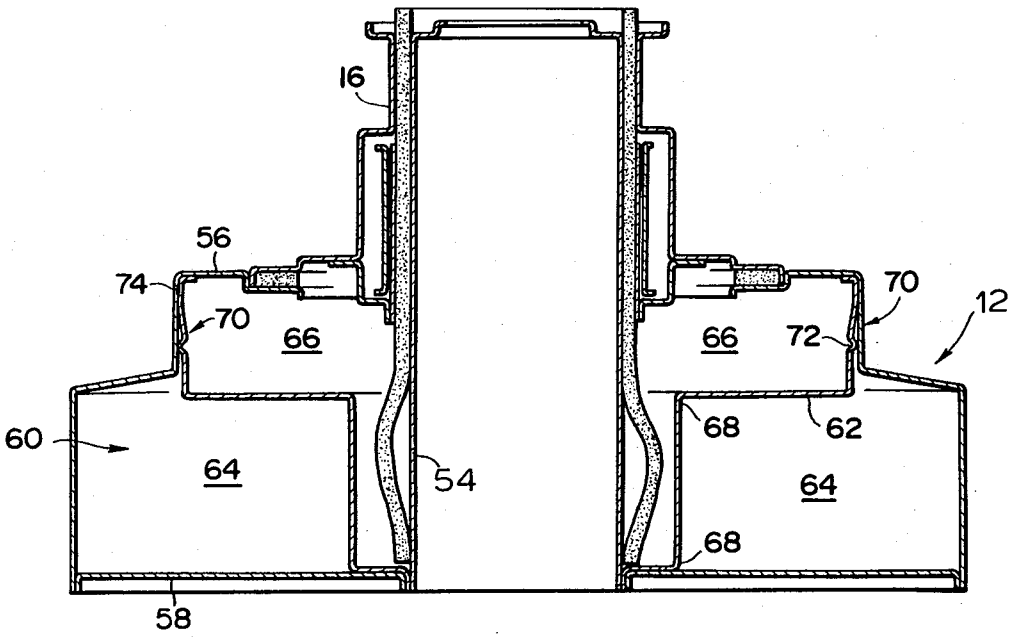
FIG. 2 is a fragmentary vertical sectional view showing an embodiment of an oil reservoir according to the present invention.
Figure 3:
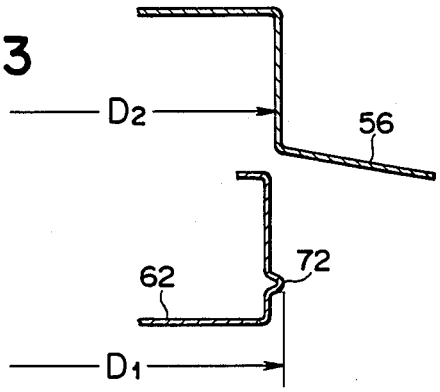
FIG. 3 is a fragmentary schematic sectional view showing an essential part of the oil reservoir shown in FIG. 2.

The oil reservoir 12 of the illustrated embodiment is shown in FIGS. 1 to 3. FIG. 2 enlargedly shows the oil reservoir 12, from which the wick actuating mechanism 42 is substantially deleted for the sake of brevity.

The oil reservoir 12 which is adapted to store fuel oil such as kerosene or the like therein is generally formed into an annular shape and arranged around the central base cylinder 54 so as to oil-tightly surround the cylinder 54. The oil reservoir 12 includes a cover plate 56 having a round outer end surface and a bottom plate 58 having a round outer end and oil-tightly mounted in the cover plate 56 to form a housing. In the illustrated embodiment, the cover plate 56 and bottom plate 58 are formed into an annular shape, so that an annular space 60 is defined in the housing. Also, in the illustrated embodiment, the cover plate 56 is formed so as to constitute upper and side walls of the housing of the oil reservoir 12 and the bottom plate constitutes a bottom wall of the housing. The oil reservoir 12 may be constructed by welding the housing constituted by the cover and bottom plates 56 and 58 to the central base cylinder 54 of the oil burner 10. The oil reservoir 12 also includes a partition plate 62 of an annular shape interposedly arranged between the cover plate 56 and the bottom plate 58 in the housing, so that the annular space 60 in the oil reservoir is divided into an oil storing chamber 64 and a wick receiving chamber 66, which are communicated through at least one communication hole 68 formed at the partition plate 62 with each other. In the illustrated embodiment, two such communication holes 68 are formed in a manner to be vertically spaced from each other. The communication holes 68 serve to ensure fluid-communication between the oil storing chamber 64 and the wick receiving chamber 66.

In the illustrated embodiment, oil-tight fixing of the partition plate 62 to the cover plate 56 is carried out through a ring-like or annular overlap 70 of a certain or relatively large width formed between the partition plate 62 and the cover plate 56. One of the cover plate 56 and partition plate 62 is formed with a ring-like or annular projection 72 at the overlap 70 in a manner to be opposite to the other of the cover plate 56 and partition plate 62, so that the cover plate 56 and partition plate 62 may be forcedly or elastically abutted against each other by means of the projection 72. The projection 72 is arranged along a whole circumference of the overlap 6, resulting in being formed into a annular or ring-like shape. The cover plate 56 and partition plate 62 are fixed together at or near the overlap 70 by spot-welding a plurality of spot welding portions 74 provided at both plates so as to prevent one of them from being separated from the other. The spot welding portions may be arranged so as to be spaced at equal intervals from one another in a circumferential direction of the oil reservoir.

A whole configuration of the overlap 72 between the cover plate 56 and the partition plate 62 is substantially cylindrical when it is formed between vertical portions of the cover plate 56 and partition plate 62 as shown in FIGS. 2 and 3; whereas it is in the form of a flat doughnut-like shape when the overlap 72 is formed between horizontal or substantially horizontal portions of both.

When the overlap 70 is formed between the vertical portions of the cover plate 56 and partition plate 62 or into a cylindrical shape as shown in FIGS. 2 and 3, it is preferable that a maximum outer diameter D1 of the partition plate 62 at the overlap 70 is defined to be larger than an inner diameter D2 of the cover plate 56 at the overlap. In FIG. 2, the projection 72 is provided for this purpose, which is formed by circumferentially outwardly projecting a part of the vertical portion of the partition plate 62. When the partition plate 62 provided with the so-formed projection 72 is fitted in the cover plate 56, the projection 72 is forcedly abutted against an inner surface of the cover plate 56 to securely hold the partition plate 62 in the cover plate 56.

Figure 4A:
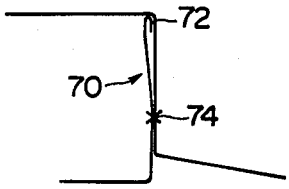
FIGS. 4A to 4D each are a schematic view showing a modification of the oil reservoir shown in FIG. 2.
Figure 4B:
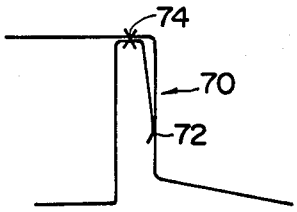
Figure 4C:
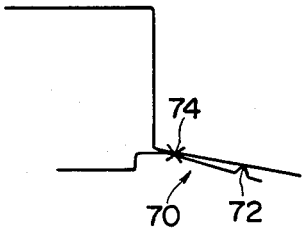
Figure 4D:
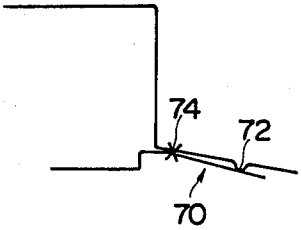

When the overlap 70 is formed between the horizontal or substantially horizontal portions of the cover plate 56 and partition plate 62 or into a flat doughnut-like shape as shown in FIGS. 4C and 4D described hereinafter, the projection 72 acts to force the overlapped portions of both plates against each other to ensure secure engagement therebetween when spot welding is carried out.

FIGS. 4A to 4D each show a form of the projection 72 and a relationship between the projection 72 and the overlap 70, wherein a mark "x" indicates a position of spot welding. In FIG. 4A, a circumferential or annular projection 72 is formed by outwardly turning up a tip end of a vertical upper portion of the partition plate 62 forming a cylindrical overlap 70 in cooperation with the cover plate 56 so that a maximum outer diameter of the partition plate 62 may be larger than an inner diameter of the cover plate and spot welding 74 is carried out at the overlap 70. In FIG. 4B, a circumferential or annular projection 72 is formed by outwardly turning up an upper portion of the partition plate 62 and then outwardly projecting a tip end of the upper portion. The turned-up upper portion of the partition plate 62 forms a cylindrical overlap 70 in cooperation with a vertical portion of the cover plate 56. Spot welding 74 is carried out adjacent to the overlap 70. In FIG. 4C, a flat doughnut-like overlap 70 is formed and spot welding 74 and a projection 72 are formed at the overlap 70. Also, the projection 72 is formed at the partition plate 62. FIG. 4D is substantially the same as FIG. 4C except that a projection 72 is formed at the cover plate 56.

In the oil reservoir 12 of the illustrated embodiment, when the cover plate 56 and partition plate 62 are fixed together by spot welding 74 as described above, the annular projection 72 formed at one of the cover plate 56 and partition plate 62 is forcedly pressed against the other, resulting in both being sealedly or intimately contacted together and securely engaged together at the projection 72. Also, any gap possibly formed between the cover plate 56 and the partition plate 62 due to the projection 72 is eliminated by spot welding, so that fluid-tightness of the overlap 70 may be effectively ensured.

As can be seen from the foregoing, in the oil reservoir of the present invention, the overlap of a relatively large width is formed between the cover plate and the partition plate and provided with the projection which serves to ensure secure engagement between both plates and forcedly press both plates against each other to enhance fluid-tightness therebetween. Also, fixing between both plates which further promotes fluid-tightness therebetween is readily accomplished by spot welding other than seam welding. Thus, it will be noted that the oil reservoir of the present invention significantly improves workability, decreases in the number of parts used and reduces manufacturing costs.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. An oil reservoir for an oil burner comprising:

a cover plate having a round outer end;

a bottom plate having a round outer end and sealedly connected to a bottom of said cover plate to form a housing in which a closed space is defined; and an annular partition plate arranged in said housing and connected at an upper end thereof to said cover plate and at a lower end thereof to said bottom plate to divide said closed space into an oil storing chamber and a wick receiving chamber, said partition plate being formed with at least one communication hole for ensuring fluid-communication between said oil storing chamber and said wick receiving chamber;

said partition plate and cover plate being provided with a plurality of spot welding portions at which spot welding is carried out to fix said partition plate and cover plate together;

said partition plate and cover plate being opposite to each other through an annular overlap formed therebetween;

one of said partition plate and cover plate being formed with an annular projection at said overlap, said projection being arranged in a manner to project toward the other of said partition plate and cover plate to forcedly press said partition plate and cover plate against each other;

said overlap being arranged at or near said spot welding portions.

2. An oil reservoir as defined in claim 1, wherein said cover plate and bottom plate each are formed into an annular shape.

3. An oil reservoir as defined in claim 1, wherein said cover plate constitutes top side walls of said housing and said bottom plate constitutes a bottom wall of said housing.

4. An oil reservoir as defined in claim 1, wherein said spot welding portions are arranged so as to be spaced at equal intervals from one another.

5. An oil reservoir as defined in claim 1, wherein said overlap is arranged at said spot welding portions.

6. An oil reservoir as defined in claim 1, wherein said overlap is arranged near said spot welding portions.

7. An oil reservoir as defined in claim 1, wherein said overlap is formed into a cylindrical shape and a said partition at said overlap is formed into a maximum outer diameter larger than an inner diameter of said cover plate at said overlap.

8. An oil reservoir as defined in claim 1, wherein said overlap is formed into a flat doughnut-like shape.

* * * * *